44-50 EX
C9048 XP 4,566,877

United States Patent [19]
Pazdej et al.

[11] Patent Number: 4,566,877
[45] Date of Patent: Jan. 28, 1986

[54] CARBON FOAM USABLE AS BLAST-FURNACE FUEL AND METHOD OF MAKING SAME

[75] Inventors: Richard Pazdej, Maizieres-les-Metz; Albert Pavinato, Metz-Vallieres, both of France

[73] Assignee: Institut De Recherches De La Siderurgie Francaise, Saint-German-en-Laye, France

[21] Appl. No.: 598,574

[22] Filed: Apr. 9, 1984

[30] Foreign Application Priority Data

Apr. 7, 1983 [FR] France ..... 83 05826

[51] Int. Cl.[4] ..... C10L 1/36
[52] U.S. Cl. ..... 44/51; 44/61
[58] Field of Search ..... 44/51, 61

[56] References Cited

U.S. PATENT DOCUMENTS

| | | | |
|---|---|---|---|
| 3,902,869 | 9/1975 | Friberg et al. | 44/51 |
| 4,082,516 | 4/1978 | Metzger | 44/51 |
| 4,304,572 | 12/1981 | Wiese et al. | 44/51 |
| 4,305,729 | 12/1981 | Stearns | 44/51 |
| 4,436,528 | 3/1984 | Schick et al. | 44/51 |

*Primary Examiner*—Y. Harris-Smith
*Attorney, Agent, or Firm*—Michael J. Striker

[57] ABSTRACT

A process for conditioning carbon rich material in the form of finely divided solid particles includes the steps of mixing at least 70% of the finely divided solid particles with an aqueous solution, mixing in approximately 0.1 to 5% of a surface active additive with foaming properties, homogenizing and aerating the resultant to produce a carbon foam.

13 Claims, No Drawings

CARBON FOAM USABLE AS BLAST-FURNACE FUEL AND METHOD OF MAKING SAME

BACKGROUND OF THE INVENTION

The present invention relates to conditioning a carbon rich material, in particular coal, for the purpose of obtaining a product which can be easily transported through pipes and which is easy to store over long periods of time. More particularly, it relates to a process for conditioning a carbon rich material applicable, preferably but not exclusively, to the injection of auxiliary fuel into the nozzles of a blast furnace of the type used in the iron industry.

Processes for conditioning a carbon rich material of the above mentioned general type are known in the art. The injection of auxiliary fuel into the nozzles of a blast furnace is a practice which has been known for a long time and utilizes a hydrocarbon, such as fuel oil. Research and development effort is presently being exerted with a view to replacing, at least partially, fuel oil with finely ground coal.

In the present state of the art, two techniques will appear to be accepted by industry within a few years.

The first one consists of blowing dry coal particles from a storage hopper to the nozzles by means of a carrier gas. This technique which makes special use of the pneumatic conveyance of powders in a dense phase and can therefore be considered as one that can be or has already been mastered. It has however, several drawbacks which, although they are not restrictive, may nevertheless slow down the development of the process.

The main drawback involves the conditioning of the coal itself into fine particles. Very careful precautions must indeed be taken in order to avoid risks of explosion which might result from the suspension of particles into the atmosphere all through the process which starts with grinding followed by storage and then transportation. Furthermore, at the grinding stage itself, which is carried out in the dry state, it is necessary to dry the initial product which expends energy.

The second technique consists of conditioning the finely ground coal by suspending it in a liquid phase (generally water), in order to form coal-water mixture having a high coal concentration usually known as "pulp". The idea seems very attractive on the surface for a pulp of this type is usually a product which has characteristics, regarding transportation, that are analogous to those of a liquid and thus making it possible, in principle, to use lines that may already be in existence without any major modifications for the transportation of fuel oil.

The idea also seems attractive because of hydrogen enrichment of the gas recovered at the top of the apparatus through dissociation of the injected water. Nevertheless, this aspect of increasing the value of the top gas can only be of secondary importance for economic considerations show that the process is of interest only for high values of the coal concentration in the pulp such as 70% and higher (by weight). Now, studies carried out to this day seem to indicate that possibilities at that level become rapidly limited due to the very fast increase in viscosity of the pulp at values greater than 75% by weight of the coal, which then makes the pumping and circulation thereof difficult in pipes using the means usually available for those purposes.

Another drawback is concerned with storage, which may result from the tendency of the coal powder to settle out over more or less prolonged periods of time.

SUMMARY OF THE INVENTION

Accordingly, it is an object of the present invention to provide a process for conditioning carbon rich materials which avoids the disadvantages of the prior art.

More particularly, it is an object of the present invention to provide a process for conditioning carbon rich materials which produces a product in the form of an aerated foam which is light but consistent, homogeneous and stable and which can be easily transported through pipes pneumatically or mechanically.

In keeping with these objects, and with others which will become apparent hereinafter, one feature of the present invention resides, briefly stated, in a process for conditioning carbon rich materials in the form of finely divided solid particles consisting of mixing at least 70% of the finely divided solid particles with an aqueous solution wherein approximately 0.1% to 5% of a surface active additive with foaming properties is mixed in and the resulting mixture is homogenized and aerated.

Another feature of the invention is also a conditioned mixture produced by the above-described method.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF PREFERRED EMBODIMENTS

In accordance with the present invention, an aerated mixture is proposed which includes at least 70% of a carbon rich material, approximately 0.1 to 5%, with respect to the weight of the carbon rich material, of a surface active additive with foaming properties, and the remainder being a liquid designed to suspend said carbon rich material.

For producing the above-described mixture a carbon rich material is conditioned. More particularly, at least 70% of the finely divided solid particles are mixed with an aqueous solution. Then, in approximately 0.1 to 5%, with respect to the weight of carbon material, of a surface additive with foaming properties is admixed. The thus-obtained mixture is homogenized. Finally, the mixture is aerated by swirling until a foam is obtained.

According to one embodiment, the additive is a laurylsulfate of an alkali or an alkaline earth metal, such as sodium or calcium, and is preferably based on an alcohol with, for example, a $C_{12}$ or $C_{14}$ carbon chain.

In the preferred embodiment, the weight proportion of additive is in the mixture range of 0.5 to 1.5% with respect to the weight of carbon material.

In the process for carrying out the aforementioned conditioning operation, the carbon material used as finely divided solid particles is mixed with a liquid such as water and with a surface active additive having foaming properties according to the aforementioned proportions and in that the mixture is aerated by mechanical or pneumatic swirling or by any other appropriate means until a foam is obtained.

Contrary to known pulps which are two-phase (solid-liquid) mixtures, the carbon foam according to the present invention (three-phase solid-liquid-gas mixture) can be stored without any difficulty over very long periods of time and can be transported through pipes and can have carbon contents which are higher than the limiting values (75–80%) encountered in pulps.

When storage is prolonged, the foam can dry up as a result of the evaporation of water. This can be easily corrected before use, for example, by adding the missing water and swirling the mixture so as to regenerate a foam which is identical to the original foam.

The preparation, which is extremely simple, will now be described by taking as an example the production of a small quantity of material such as that prepared in the laboratory. The base carbon material is coal which has been previously finely ground so that an overall grain size distribution is obtained which is less than 500 μm but approximately 80% of which has a grain size distribution of less than 100 μm. These specifications are especially recommended because of the end use of the coal (combustion in a burner) for which it is of value to obtain particles with large surface areas.

750 g of this powdered coal is placed in a beaker into which 250 ml of a slightly basic aqueous solution (having an approximate pH of 8), with a 1% sodium laurylsulfate content with respect to the weight of the solid, is then poured. Therefore, the quantity of laurylsulfate in the 250 ml of solution is approximately 7.5 g. The adjustment of pH to a basic value is recommended by the manufacturer of the laurylsulfate and is determined in order to facilitate its solubilization.

The sodium laurylsulfate used in this example, based on a $C_{12}$ alcohol, is marketed under the designation "Empicol LX 28". It is liquid and contains a small quantity of formaldehyde as a preservative. Its chemical nature can be represented by $CH_3(CH_2)_nCH_2OSO_3Na$. These Empicols are anionic surface active agents having foaming properties which can also be used as wetting and emulsifying agents. They are usually used in the manufacture of shampoos for rugs, elastomers or latex foams.

The contents of the beaker are then homogenized and aerated by mechanical swirling using a rotating blade mounted at the extremity of a motor driven rod. The swirling operation lasts for several minutes at the end of which the desired carbon foam is obtained. This foam has a volume of approximately 2 liters. The coal is present therein in the quantity of 75% by weight and in the ratio of 375 g per liter of foam.

It is of course possible to add the water and the foaming surface active agent separately.

Similarly, the swirling can be effected mechanically (stirrer, turbine, mixer with a planetary motion, etc.) or pneumatically (bubbling, gaseous spray, etc.) or by any other means providing for the aeration of the mixture so that gaseous microbubbles can be incorporated therein which attach themselves to the polar ends of the foaming surface active additive.

The carbon foam according to the present invention can also be obtained from additives other than a sodium laurylsulfate that have surface active properties which enhance the wetting of the coal particles by the liquid phase and foaming properties, i.e., a hydrophobic-polar part designed to bind the gaseous phase as microbubbles.

Thus, it is possible to use additives such as laurylsulfates of calcium or of other alkali or alkaline earth metals, sulfonates, laurylsulfonates or phenylsulfonates of Na or Ca, alkyl sulfonates or sulfonic esters, etc.

Similarly, the suspending liquid need not necessarily be water but may very well consist, for example, of a hydrocarbon such as fuel oil or a fuel oil-water mixture, which provides if necessary an increase in the calorific value of the foam.

Nevertheless, the main value of the invention is realized when water is used. For it is in this case that the known pulps having high carbon contents, raise problems with regard to transportation in pipes which problems are no longer found with the foam according to the present invention. The characters of which are substantially constant regardless what the proportion of carbon may be.

The carbon foam according to the present invention has many other advantages, for example:

ease of storage over very long periods of time without any risk of sedimentation or decantation of the solid particles;

little or no granulometric segregation during storage;

absolute chemical neutrality with respect to the usual means of storage;

simple and very fast preparation allowing for a continuous production at the time of use;

low abrasion of the means of conveyance (pumps, pipes, etc.);

practically complete safety with respect to explosion hazards since the application of the present invention does not generate dust;

the grinding of the coal can be carried out in water without requiring subsequent drying; and use by present day liquid injection installations which require few or no conversions depending on the particular case.

Thus, the carbon foam according to the present invention can be obtained from the different known varieties of coals regardless of their grade (dry or soft coals) and may be or more generally be from any other material (rich in carbon) which may be finely divided into solid particles (lignite, peat, coal tar pitch, etc.).

Similarly, the field of application of the invention is not limited to the injection of fuels into the nozzles of a blast furnace of the type used in the iron industry, but extends to other uses such as, for example, in the field of industrial furnaces, thermal plants and in the transportation of coal over long distances and, more generally, wherever injection and transportation of a coal-water mixture are of value.

It will be understood that each of the elements described above, or two or more together, may also find a useful application in other types of conditioning of a carbon rich material and process for carrying out same differing from the types described above.

While the invention has been illustrated and described as embodied in a process and product, it is not intended to be limited to the details shown, since various modifications and may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mixture comprising:

at least 70% by weight of a solid carbon-rich material;

between 0.07% and 3.5% by weight of a foaming surfactant; and balance gaseous bubbles and aqueous liquid capable of suspending the carbon-rich material.

2. The mixture defined in claim 1 wherein the material is a finely divided particulate.

3. The mixture defined in claim 1 wherein the particulate is finely divided coal.

4. The mixture defined in claim 3 wherein the particulate has an overall grain-size distribution less than 500 microns of which about 80% by weight has a particle size smaller than 100 microns.

5. The mixture defined in claim 1 wherein the liquid is water.

6. The mixture defined in claim 1 wherein the surfactant is an alkali sulfonate.

7. The mixture defined in claim 6 wherein the additive is an alkaline earth metal.

8. The mixture defined in claim 1 wherein the surfactant is an alkali selected from the group consisting of
laurylsulfates,
laurylsulfonates,
phenylsulfonates,
alkylsulfonates, and
sulfonic esters.

9. The mixture defined in claim 1 wherein the additive is an alkaline earth-metal sulfonate selected from the group consisting of
laurylsulfates,
laurylsulfonates,
phenylsulfonates,
alkylsulfonates, and
sulfonic esters.

10. The mixture defined in claim 1 wherein the surfactant is an alcohol-based sodium laurylsulfate having the general formula $CH_3(CH_2)_nCH_2OSO_3Na$ and whose weight in the mixture is in the range of 0.5% to 1.5% by weight with respect to the weight of the carbon-rich material.

11. The mixture defined in claim 10 wherein the weight of the mixture is about 1% of the weight of the carbon-rich material.

12. A method of preparing a mixture containing finely divided solid carbon-rich particulates, the method comprising the steps of:

mixing together at least 70% by weight of a solid carbon-rich material, between 0.07% and 3.5% by weight of a foaming surfactant, and balance mainly an aqueous liquid capable of suspending the carbon-rich material;

homogenizing the mixture; and aerating the mixture to form therein stable gaseous bubbles.

13. The use as blast-furnace fuel of a mixture comprising:

at least 70% by weight of a solid carbon-rich material;

between 0.07% and 3.5% by weight of a foaming surfactant; and balance gaseous bubbles and aqueous liquid capable of suspending the carbon-rich material.

* * * * *